US012735223B1

(12) United States Patent
Philips et al.

(10) Patent No.: US 12,735,223 B1
(45) Date of Patent: Sep. 15, 2026

(54) PACKAGING ITEMS WITH LOCKING ROLLOVER FLAPS

(71) Applicant: Packaging Corporation of America, Lake Forest, IL (US)

(72) Inventors: Nicholas A Philips, Sugar Grove, IL (US); Keith A. Jackson, Round Lake, IL (US)

(73) Assignee: Packaging Corporation of America, Lake Forest, IL (US)

( * ) Notice: Subject to any disclaimer, the term of this patent is extended or adjusted under 35 U.S.C. 154(b) by 196 days.

(21) Appl. No.: 18/443,704

(22) Filed: Feb. 16, 2024

Related U.S. Application Data

(60) Provisional application No. 63/498,900, filed on Apr. 28, 2023, provisional application No. 63/491,420, filed on Mar. 21, 2023.

(51) Int. Cl.
*B65D 5/22* (2006.01)
*B65D 5/20* (2006.01)

(52) U.S. Cl.
CPC ..... *B65D 5/22* (2013.01); *B65D 5/2047* (2013.01)

(58) Field of Classification Search
CPC ..... B65D 5/22; B65D 5/2047; B65D 5/0035; B65D 5/0045; B65D 5/0025; B65D 5/4608; B65D 5/0015; B65D 5/248; B65D 5/28; B65D 5/443; B65D 5/005; B65D 5/002; B65D 81/3813
USPC ..... 229/151, 177, 178, 918, 174, 179, 915, 229/919, 109, 149, 176, 190; 206/509, 206/511
See application file for complete search history.

(56) References Cited

U.S. PATENT DOCUMENTS

| | | | | | |
|---|---|---|---|---|---|
| 2,395,364 | A | | 2/1946 | Williams | |
| 2,407,463 | A | | 9/1946 | Williams | |
| 2,665,050 | A | | 1/1954 | Martin | |
| 2,702,155 | A | | 2/1955 | Martin | |
| 3,696,989 | A | * | 10/1972 | Kochevar | B65D 5/0035 229/177 |
| 3,883,067 | A | * | 5/1975 | McGlynn | B65D 5/22 229/179 |
| 3,933,300 | A | | 1/1976 | Dempster | |
| 3,973,723 | A | * | 8/1976 | Owens | B65D 5/6632 229/176 |
| 4,417,686 | A | | 11/1983 | Wozniacki | |
| 4,600,142 | A | | 7/1986 | Quaintance | |
| 4,676,429 | A | | 6/1987 | Crowe et al. | |
| 4,792,084 | A | | 12/1988 | Dreeszen | |
| 5,398,868 | A | | 3/1995 | Densen | |

(Continued)

*Primary Examiner* — Christopher R Demeree
(74) *Attorney, Agent, or Firm* — Klarquist Sparkman, LLP

(57) ABSTRACT

A container includes side walls and end walls including a first end wall panel. A first end flap is coupled to the first side wall panel and has an upper edge defining a notch. A second end flap is coupled to the second side wall panel on the opposite side of the first end wall panel from the first end flap and has an upper edge defining a notch. A rollover flap is coupled to the first end wall panel by a trapezoidal hinge portion. The first and second end flaps are folded into an overlapping arrangement inward of the first end wall panel such that the notches of the first and second end flaps are aligned. The rollover flap is folded over the first and second end flaps and downwardly inside the container, and the hinge portion is received in the notches to form the first end wall.

21 Claims, 10 Drawing Sheets

(56) References Cited

U.S. PATENT DOCUMENTS

| | | | | |
|---|---|---|---|---|
| D361,892 | S | 9/1995 | Quaintance | |
| 5,752,648 | A | 5/1998 | Quaintance | |
| 6,598,785 | B2 | 7/2003 | Quaintance | |
| 6,651,873 | B2 | 11/2003 | Quaintance | |
| 6,749,107 | B2 | 6/2004 | Quaintance | |
| 7,036,718 | B2 | 5/2006 | Quaintance | |
| 7,131,570 | B2 | 11/2006 | Quaintance | |
| 7,469,815 | B2 | 12/2008 | Quaintance | |
| 7,549,570 | B2 | 6/2009 | Quaintance | |
| 7,628,313 | B2 * | 12/2009 | Fry | B65D 5/0015 229/179 |
| 7,673,787 | B2 | 3/2010 | Mittelstaedt | |
| 7,717,320 | B2 | 5/2010 | Quaintance | |
| 7,806,313 | B2 | 10/2010 | Philips | |
| 7,854,371 | B2 | 12/2010 | Mittelstaedt | |
| 7,891,541 | B2 | 2/2011 | Mittelstaedt | |
| 8,205,787 | B2 | 6/2012 | Panduro et al. | |
| 8,802,205 | B2 | 8/2014 | Bugas et al. | |
| 10,364,058 | B2 | 7/2019 | Wiley | |
| D867,875 | S | 11/2019 | Greenfield | |
| 10,577,145 | B2 | 3/2020 | Bevier | |
| 10,954,024 | B2 | 3/2021 | Wiley | |
| 2005/0067478 | A1 * | 3/2005 | McClure | B65D 5/22 229/177 |
| 2006/0138204 | A1 * | 6/2006 | Keefe, Jr. | B65D 5/002 229/179 |
| 2006/0278691 | A1 | 12/2006 | Bezek | |
| 2017/0166372 | A1 | 6/2017 | Bugas | |
| 2024/0391639 | A1 * | 11/2024 | McCarthy | B65D 5/0015 |

* cited by examiner

PACKAGING ITEMS WITH LOCKING ROLLOVER FLAPS

CROSS REFERENCE TO RELATED APPLICATIONS

The present application claims the benefit of U.S. Provisional Application No. 63/498,900, filed Apr. 28, 2023, and claims the benefit of U.S. Provisional Application No. 63/491,420, filed Mar. 21, 2023. Each of the above applications is incorporated herein by reference in its entirety.

FIELD

The present disclosure pertains to packaging items, such as containers, that are erected by hand and include rollover flaps with hinge portions that are received in notches defined in end flap panels of the container walls to lock the rollover flaps in place.

BACKGROUND

Corrugated containers are used in collecting and processing agricultural products such as produce and meat products. Such containers are sometimes erected onsite at the processing facility using forming machinery that folds and glues container blanks to form finished containers. Occasionally, the forming machinery is unavailable, and containers of different designs can be erected by hand to allow continued operation of the processing facility. However, some existing hand-erected container designs have a tendency to come apart during use. Accordingly, there exists a need for improved hand-erected corrugated containers.

SUMMARY

Certain examples of the disclosure pertain to packaging items, such as containers, that are erected by hand and include rollover flaps with hinge portions that are received in notches defined in end flap panels of the container walls to lock the rollover flaps in place. In a representative example, a container comprises a bottom panel forming a container bottom; a first side wall panel coupled to the bottom panel and forming a first side wall of the container; a second side wall panel coupled to the bottom panel and forming a second side wall of the container; a first end wall panel coupled to the bottom panel and forming a first end wall of the container; a second end wall panel coupled to the bottom panel and forming a second end wall of the container; a first end flap panel coupled to the first side wall panel, the first end flap panel comprising an upper edge defining a notch; a second end flap panel coupled to the second side wall panel on the opposite side of the first end wall panel from the first end flap panel, the second end flap panel comprising an upper edge defining a notch; a first rollover flap coupled to the first end wall panel by a trapezoidal hinge portion including two parallel fold lines and two non-parallel cuts; wherein the first end flap panel and the second end flap panel are folded into an overlapping arrangement inward of the first end wall panel such that the notch of the first end flap panel is aligned with the notch of the second end flap panel; and wherein the first rollover flap is folded over the first end flap panel and the second end flap panel and downwardly inside the container, and the trapezoidal hinge portion is received in the notch of the first end flap panel and the notch of the second end flap panel to form the first end wall.

In any or all of the disclosed examples, the notch of the first end flap panel has a first depth; and the notch of the second end flap panel has a second depth that is different from the first depth.

In any or all of the disclosed examples, the first depth is greater than the second depth.

In any or all of the disclosed examples, the first end flap panel is disposed inwardly of the second end flap panel; the first rollover flap comprises an upwardly extending tab on the inside of the container; and the upper edge of the first end flap panel extends upwardly beyond an upper edge of the tab of the first rollover flap.

In any or all of the disclosed examples, at least an inward portion of the hinge portion is angled downwardly as it extends through the notch of the first end flap panel.

In any or all of the disclosed examples, the tab of the first rollover flap is at least partially defined by an innermost cut of the two non-parallel cuts of the hinge portion.

In any or all of the disclosed examples, the two non-parallel cuts of the hinge portion are angled toward each other such that the hinge portion has a wedge shape.

In any or all of the disclosed examples, one of the two non-parallel cuts of the hinge portion is perpendicular to the two parallel fold lines of the hinge portion.

In any or all of the disclosed examples, the two non-parallel cuts extend beyond a first of the two parallel fold lines into the first rollover flap and beyond a second of the two parallel fold lines into the first end wall panel.

In any or all of the disclosed examples, the first rollover flap comprises a plurality of tabs, the tabs comprising upper edges that are below the upper edge of the first end flap panel.

In any or all of the disclosed examples, the container further comprises a second rollover flap coupled to the second end wall panel by a trapezoidal hinge portion including two parallel fold lines and two non-parallel cuts.

In any or all of the disclosed examples, the container further comprises a cover including a main top panel, first and second side wall panels coupled to the main top panel, first and second end wall panels coupled to the main top panel, a first end flap panel coupled to the first side wall panel, the first end flap panel comprising an outer edge defining a notch, a second end flap panel coupled to the second side wall panel on the opposite side of the first end wall panel from the first end flap panel, the second end flap panel comprising an outer edge defining a notch, a first rollover flap coupled to the first end wall panel by a trapezoidal hinge portion including two parallel fold lines and two non-parallel cuts, and a second rollover flap coupled to the second end wall panel by a trapezoidal hinge portion including two parallel fold lines and two non-parallel cuts.

In another representative example, a container comprises a bottom panel forming a container bottom; a first side wall panel coupled to the bottom panel and forming a first side wall of the container; a second side wall panel coupled to the bottom panel and forming a second side wall of the container; a first end wall panel coupled to the bottom panel and forming a first end wall of the container; a second end wall panel coupled to the bottom panel and forming a second end wall of the container; a first end flap panel coupled to the first side wall panel, the first end flap panel comprising an upper edge defining a notch having a first notch depth; a second end flap panel coupled to the second side wall panel on the opposite side of the first end wall panel from the first end flap panel, the second end flap panel comprising an upper edge defining a notch having a second notch depth; a first rollover flap coupled to the first end wall panel by a hinge portion;

wherein the first end flap panel and the second end flap panel are folded into an overlapping arrangement inward of the first end wall panel with the first end flap panel disposed inwardly of the second end flap panel and such that the notch of the first end flap panel is aligned with the notch of the second end flap panel; wherein the first rollover flap is folded over the first end flap panel and the second end flap panel and downwardly inside the container, and the hinge portion is received in the notch of the first end flap panel and the notch of the second end flap panel to form the first end wall; wherein the first rollover flap comprises an upwardly extending tab on the inside of the container, and an upper edge of the first end flap panel extends upwardly beyond an upper edge of the tab of the first rollover flap.

In any or all of the disclosed examples, the hinge portion is a trapezoidal hinge portion including two parallel fold lines and two non-parallel cuts.

In any or all of the disclosed examples, the first notch depth is greater than the second notch depth.

In any or all of the disclosed examples, the tab of the first rollover flap is one of a plurality of tabs of the first rollover flap, and each tab of the plurality of tabs comprises an upper edge that is below the upper edge of the first end flap panel.

In another representative example, a container blank comprises a bottom panel; first and second side wall panels coupled to the bottom panel; first and second end wall panels coupled to the bottom panel; a first end flap panel coupled to the first side wall panel, the first end flap panel comprising an outer edge, the outer edge defining a notch having a first notch depth; a second end flap panel coupled to the second side wall panel on the opposite side of the first end wall panel from the first end flap panel, the second end flap panel comprising an outer edge, the outer edge of the second end flap panel defining a notch having a second notch depth that is less than the first notch depth; a first rollover flap coupled to the first end wall panel by a hinge portion; and a second rollover flap coupled to the second end wall panel by a hinge portion.

In any or all of the disclosed examples, the hinge portion coupling the first rollover flap to the first end wall panel is a trapezoidal hinge portion including two parallel fold lines and two non-parallel cuts.

In any or all of the disclosed examples, the first rollover flap comprises a tab, and the tab is at least partially defined by an innermost cut of the two non-parallel cuts of the hinge portion.

In any or all of the disclosed examples, the two non-parallel cuts of the hinge portion are angled toward each other such that the hinge portion has a wedge shape.

In another representative example, a container blank comprises a bottom panel; first and second side wall panels coupled to the bottom panel; first and second end wall panels coupled to the bottom panel; a first end flap panel coupled to the first side wall panel, the first end flap panel comprising an outer edge defining a notch; a second end flap panel coupled to the second side wall panel on the opposite side of the first end wall panel from the first end flap panel, the second end flap panel comprising an outer edge defining a notch; a first rollover flap coupled to the first end wall panel by a trapezoidal hinge portion including two parallel fold lines and two non-parallel cuts; a second rollover flap coupled to the second end wall panel by a trapezoidal hinge portion including two parallel fold lines and two non-parallel cuts.

The foregoing and other objects, features, and advantages of the disclosed technology will become more apparent from the following detailed description, which proceeds with reference to the accompanying figures.

DETAILED DESCRIPTION

Explanation of Terms

Figure 1A:
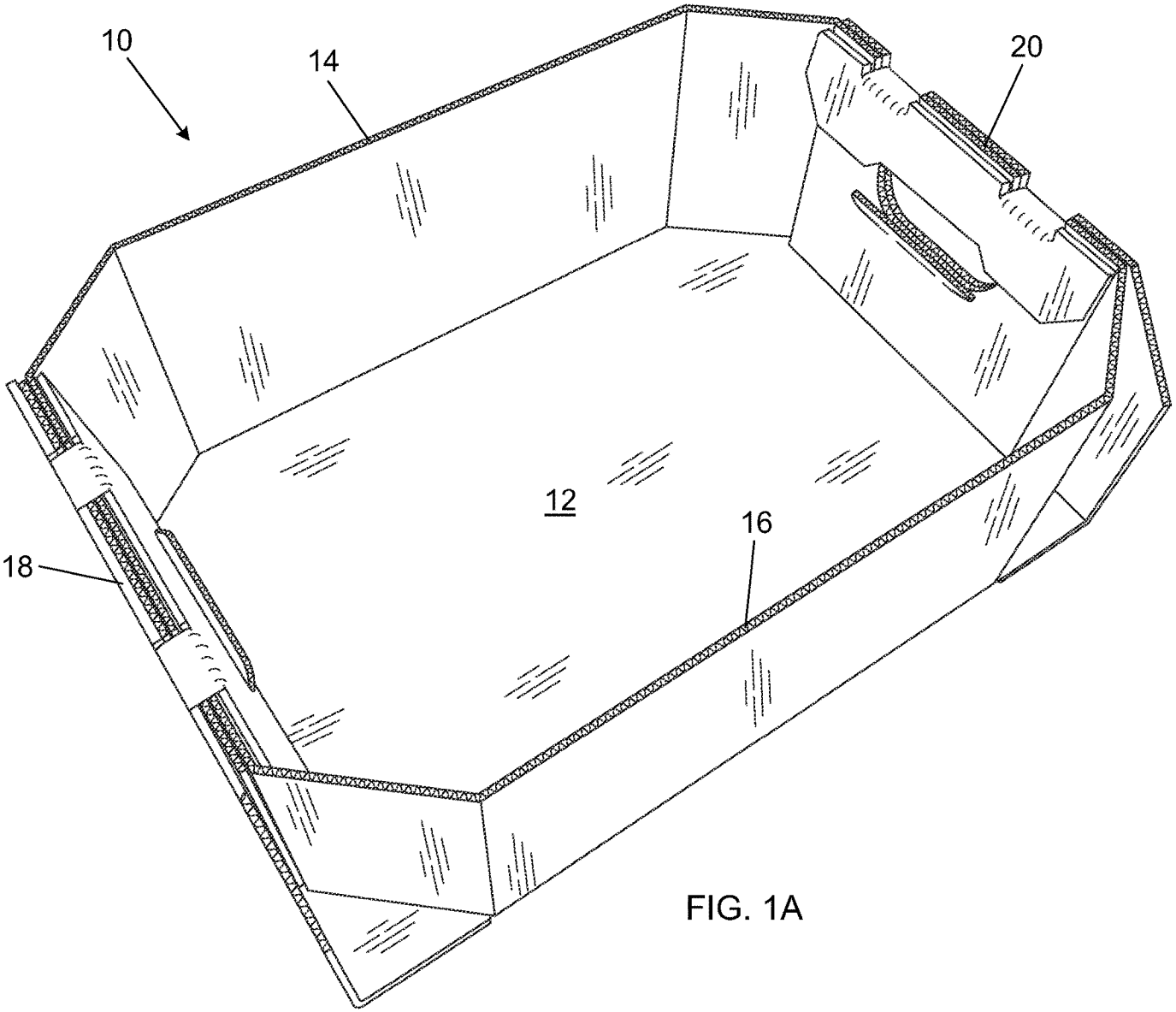
FIGS. 1A-1B are top perspective views of an example of a hand-erected corrugated container according to the present disclosure.

For purposes of this description, certain aspects, advantages, and novel features of the embodiments of this disclosure are described herein. The disclosed methods, apparatus, and systems should not be construed as being limiting in any way. Instead, the present disclosure is directed toward all novel and nonobvious features and aspects of the various disclosed embodiments, alone and in various combinations and sub-combinations with one another. The methods, apparatus, and systems are not limited to any specific aspect or feature or combination thereof, nor do the disclosed embodiments require that any one or more specific advantages be present or problems be solved.

Although the operations of some of the disclosed embodiments are described in a particular, sequential order for convenient presentation, it should be understood that this manner of description encompasses rearrangement, unless a particular ordering is required by specific language set forth herein. For example, operations described sequentially may in some cases be rearranged or performed concurrently. Moreover, for the sake of simplicity, the attached figures may not show the various ways in which the disclosed methods can be used in conjunction with other methods.

As used in this disclosure and in the claims, the singular forms "a," "an," and "the" include the plural forms unless the context clearly dictates otherwise. Additionally, the term "includes" means "comprises." Further, the terms "coupled" and "associated" generally mean electrically, electromagnetically, and/or physically (e.g., mechanically or chemically) coupled or linked and does not exclude the presence of intermediate elements between the coupled or associated items absent specific contrary language.

In some examples, values, procedures, or apparatus may be referred to as "lowest," "best," "minimum," or the like. It will be appreciated that such descriptions are intended to indicate that a selection among many alternatives can be made, and such selections need not be better, smaller, or otherwise preferable to other selections.

In the description, certain terms may be used such as "up," "down," "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object.

Unless otherwise indicated, all numbers expressing dimensions and so forth as used in the specification or claims are to be understood as being modified by the term "about." Accordingly, unless otherwise indicated, implicitly or explicitly, the numerical parameters set forth are approximations that can depend on the desired properties sought and/or limits of detection under test conditions/methods familiar to those of ordinary skill in the art. When directly and explicitly distinguishing embodiments from discussed prior art, the embodiment numbers are not approximates unless the word "about" is recited.

Although there are alternatives for various components, dimensions, parameters, operating conditions, etc., set forth herein, that does not mean that those alternatives are necessarily equivalent and/or perform equally well. Nor does it mean that the alternatives are listed in a preferred order unless stated otherwise.

As used herein, values modified by the term "substantially" mean±10% of the stated value. The term "substantially parallel" means an angle of +10° between an object and a reference. In another example, the term "substantially perpendicular" means an angle of 80° to 100° between an object and a reference. In the context of fold lines, for example, the term "parallel" is to be interpreted as falling within commonly accepted dimensional tolerances in the corrugated container industry.

Overview of the Disclosed Technology

The present disclosure pertains to packaging items with rollover flaps that are connected to end wall panels by one or a plurality of trapezoidal and/or wedge-shaped hinge portions. Corrugated containers are one example of a packaging item on which the trapezoidal and/or wedge-shaped hinge portions of the present disclosure can be implemented. End flap panels connected to side wall panels of the container are folded into an overlapping arrangement inwardly of the end wall panels. The end flap panels define one or a plurality of notches. The rollover flaps are folded over the end flap panels and inside the container such that the trapezoidal and/or wedge-shaped hinge portions are received in the notches. The wider parts of the hinge portions can be located inside the container to resist disengagement of the hinge portions from the notches. Additionally, the notches on different end flap panels can have different depths. For example, the notches on the innermost end flap panel can be deeper than the notches on the other end flap panel. This allows the rollover flap to be inserted a greater distance down into the container such that the upper edge of the innermost end flap panel extends upwardly beyond the upper edge of the rollover flap and acts as a buttress to prevent inadvertent disengagement of the rollover flap. The trapezoidal and/or wedge-shaped hinge portions and the notches of different depth can be implemented together or independently on containers and on container covers. The trapezoidal and/or wedge-shaped hinge portions and/or the notches of different depth can also be implemented on other packaging items including edge protectors, and/or on other parts of a container such as the corners.

Example 1: Containers with Locking Rollover Flaps

Figure 1B:
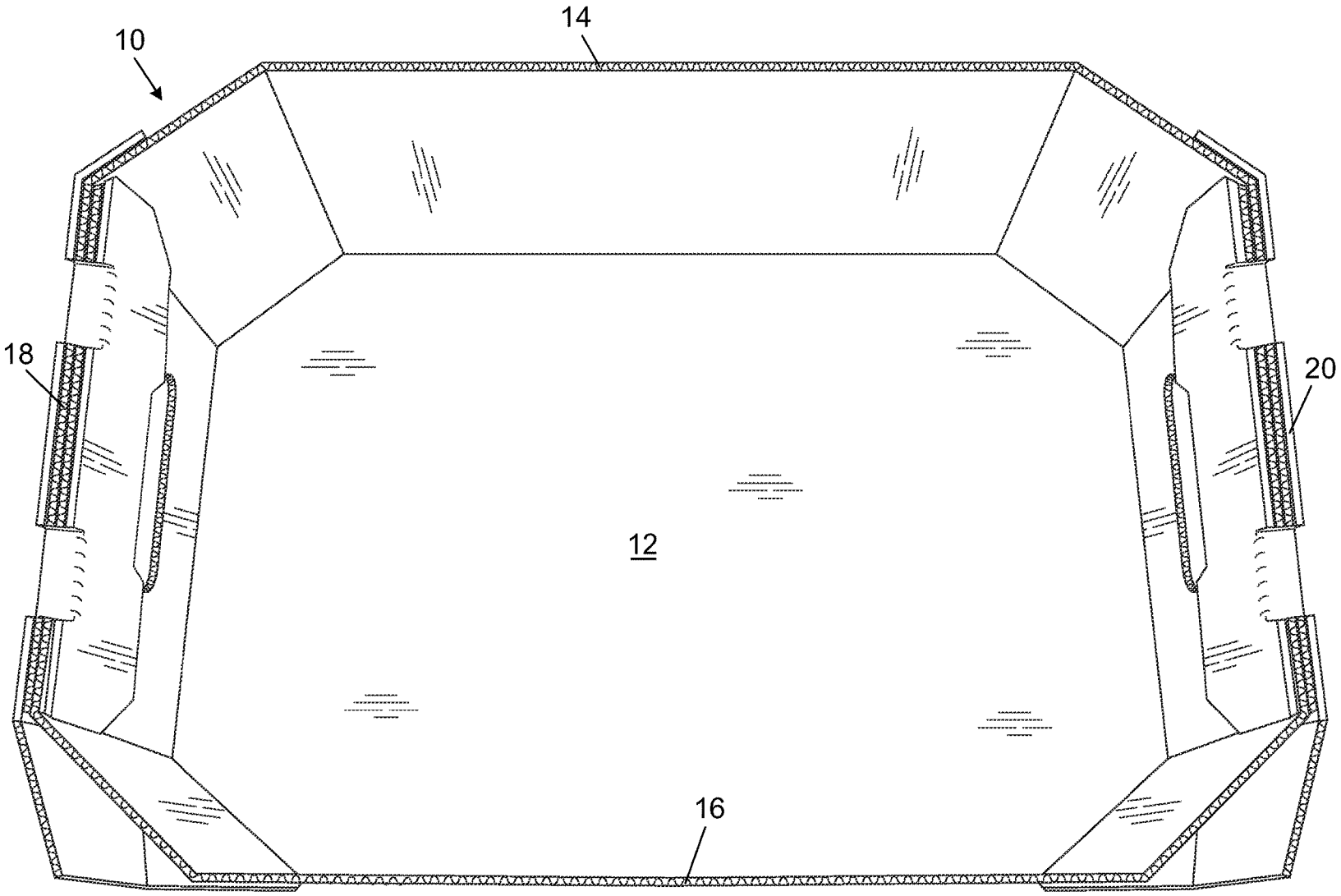

FIGS. 1A and 1B illustrate a representative example of a container 10 including a bottom 12, a first side wall 14, a second side wall 16, a first end wall 18, and a second end wall 20. The container can be erected from a flat blank (see FIG. 2) by hand without the need for adhesive or fasteners. For example, in the illustrated example the container 10 includes rollover flaps on each of the first end wall 18 and the second end wall 20 that are folded over inside the container and received in notches defined in the first and second end walls. The notches engage hinge portions connecting the rollover flaps to the end wall panels which, along with other features described in greater detail below, keep the rollover flaps in place.

The illustrated container 10 can be made of a variety of materials. However, in certain embodiments the container 10 can be made from corrugated paperboard having a corrugated layer (also referred to as a "fluted layer") between two face sheets (also referred to as "liners" or "liner layers").

Figure 2:
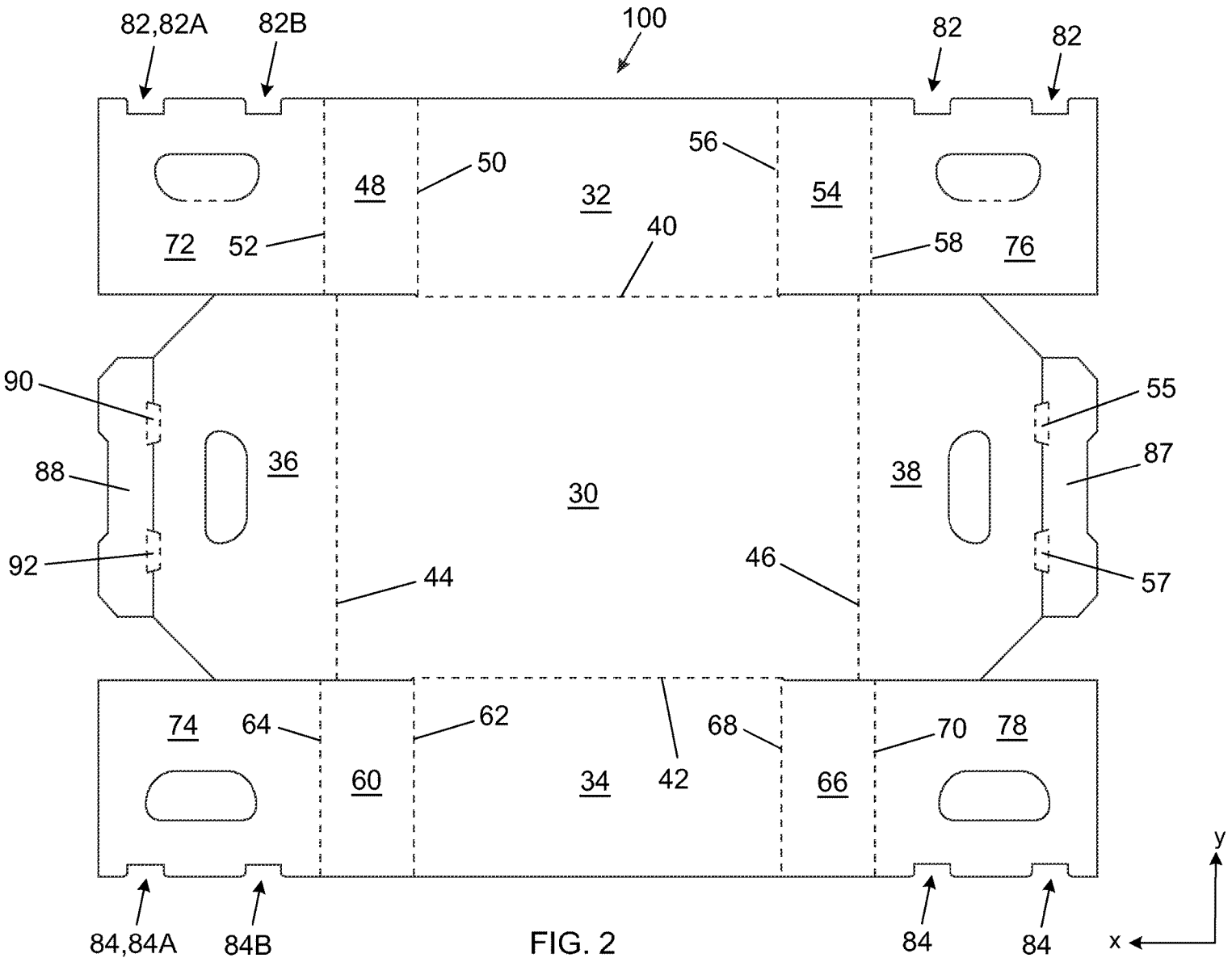
FIG. 2 illustrates a blank for forming the container of FIGS. 1A-1B.

FIG. 2 illustrates a representative example of a blank 100 from which the container 10 can be erected. The blank 100 can be a one-piece unitary blank, although in other examples components included in the illustrated blank can be separate pieces that are interconnected to form the blank. In FIG. 2, fold lines (also referred to as "creases" and "score lines") are represented as dashed lines. The edges of the blank, along with cuts in panels and between panels, are represented as solid lines. The blank 100 can comprise a main panel referred to hereinafter as a bottom panel 30. A plurality of wall panels are coupled to the bottom panel 30, including a first side wall panel 32, a second side wall panel 34, a first end wall panel 36, and a second end wall panel 38. The first side wall panel 32 is coupled to the bottom panel 30 at a fold line 40. The second side wall 34 panel is coupled to the bottom panel 30 at a fold line 42. The first and second end wall panels 36 and 38 are coupled to the bottom panel 30 at respective fold lines 44 and 46.

The first and second side wall panels 32 and 34 can each comprise a plurality of corner panels. For example, the first side wall panel 32 can comprise a corner panel 48 defined by fold lines 50 and 52, and a corner panel 54 defined by fold lines 56 and 58. The second side wall panel 34 can include a corner panel 60 defined by fold lines 62 and 64, and a corner panel 66 defined by fold lines 68 and 70.

A first end flap panel 72 can be coupled to the first side wall panel 32 at the fold line 52. A second end flap panel 74 can be coupled to the second side wall panel 34 at the fold line 64 on the opposite side of the first end wall panel 36 from the first end flap panel 72. A third end flap panel 76 can be coupled to the first side wall panel 32 at the fold line 58. A fourth end flap panel 78 can be coupled to the second side wall panel 34 at the fold line 70.

Figure 3:
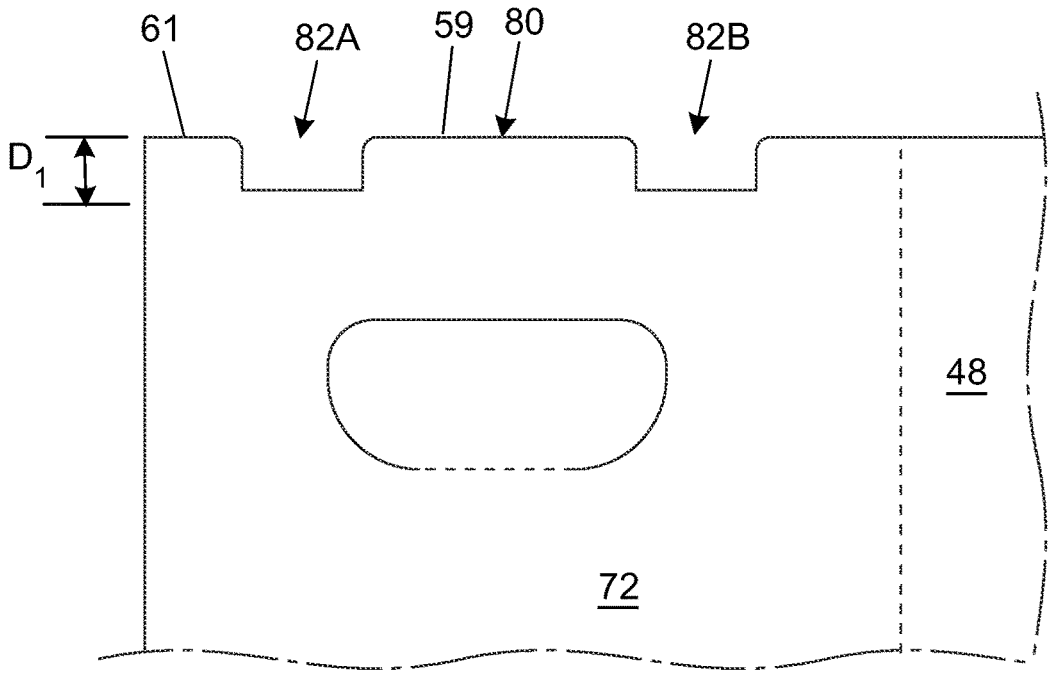
FIG. 3 is a magnified view of the first end flap panel of the blank of FIG. 2.

FIG. 3 illustrates a portion of the first end flap panel 72 in detail. The first end flap panel 72 can comprise an outer edge 80. The first end flap panel 72 can include a plurality of notches 82 formed in the outer edge 80, including the two notches 82A and 82B in the illustrated example. The notches 82A and 82B can have rounded corners and straight lower edges. The notches 82A and 82B can extend inward from the outer edge 80 by a first depth $D_1$. The notches 82A and 82B form a tab 59 between them. The upper edge of the tab 59 is part of the outer edge 80 of the first end flap panel 72. Another tab 61 is located to the left of the notch 82A in FIG. 3. In other examples, the first end flap panel 72 (and any or all of the other end flap panels) can define any number of notches, such as three notches, four notches, etc. Referring again to FIG. 2, the third end flap panel 76 can comprise a plurality of notches 82 (two in the illustrated configuration), which can be configured similarly to the notches 82A and 82B and can have the first depth $D_1$.

Figure 4:
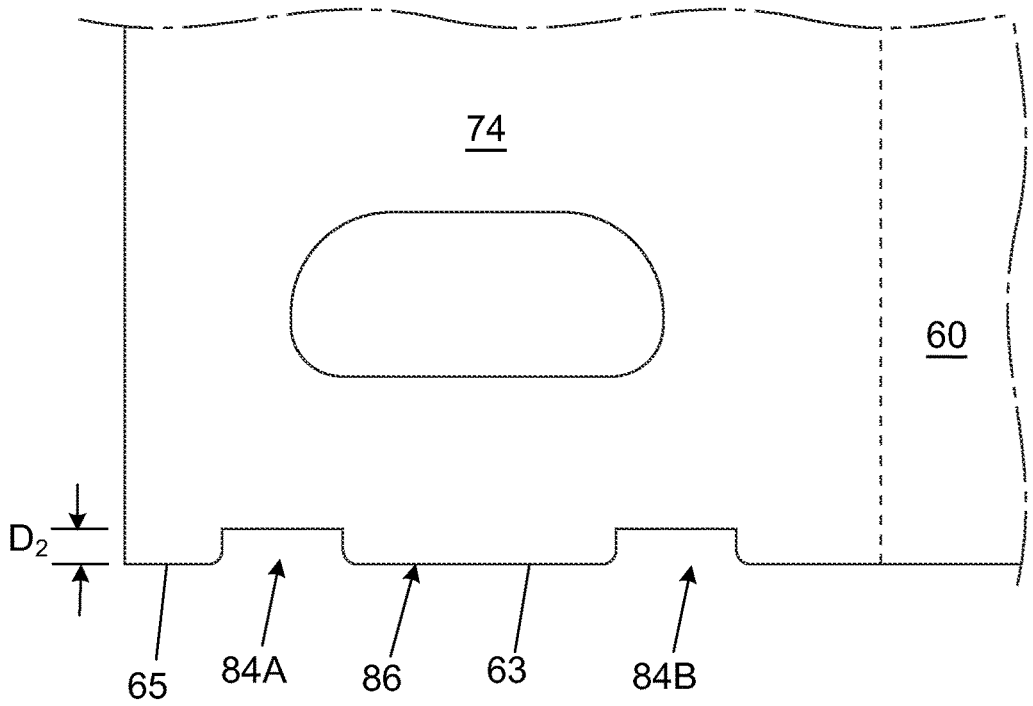
FIG. 4 is a magnified view of the second end flap panel of the blank of FIG. 2.

FIG. 4 illustrates a portion of the second end flap panel 74 in greater detail. The second end flap panel 74 can comprise a plurality of notches 84 formed in the outer edge 86 of the second end flap panel 74 corresponding to the notches 82 of the first end flap panel 72. In the illustrated example the second end flap panel 74 includes two notches 84A and 84B. The notches 84A and 84B can have rounded corners and straight lower edges, and can extend inwardly from the outer edge 86 by a second depth $D_2$. In certain examples, the second depth $D_2$ can be different from the first depth $D_1$ of the notches 82A and 82B. For example, the first depth $D_1$ of the notches 82A and 82B can be greater than the second depth $D_2$ of the notches 84A and 84B. For example, in certain examples the second depth $D_2$ can be 40% to 95% of the first depth $D_1$, such as 50% to 90%, 50% to 80%, 50% to 70%, 60% to 90%, 60% to 80%, etc. In certain examples, the second depth $D_2$ can be 70% of the first depth $D_1$. In other examples the second end flap panel can have the deeper notches.

The second end flap panel 74 can comprise a tab 63 between the notches 84A and 84B, and a tab 65 on the left side of the end flap panel 74. The outer edges of the tabs 63 and 65 can be part of the outer edge 86.

As shown in FIG. 2, the fourth end flap panel 78 can comprise two notches 84 configured similarly to the notches 84A and 84B of the second end flap panel 74 and comprising the second depth $D_2$.

Referring again to FIG. 2, the container blank 100 can further comprise a rollover flap 88 coupled to the first end wall panel 36 and a rollover flap 87 coupled to the second end wall panel 38. The rollover flap 88 can be coupled to the first end wall panel 36 by one or a plurality of hinge portions (also referred to as "webs"). In certain examples, the number of hinge portions of the rollover flaps can correspond to the number of notches formed in the end flap panels. Thus, in the illustrated example the rollover flap 88 is coupled to the first end wall panel 36 by two hinge portions 90 and 92 spaced apart from each other along the y-axis in FIG. 2.

Figure 5:
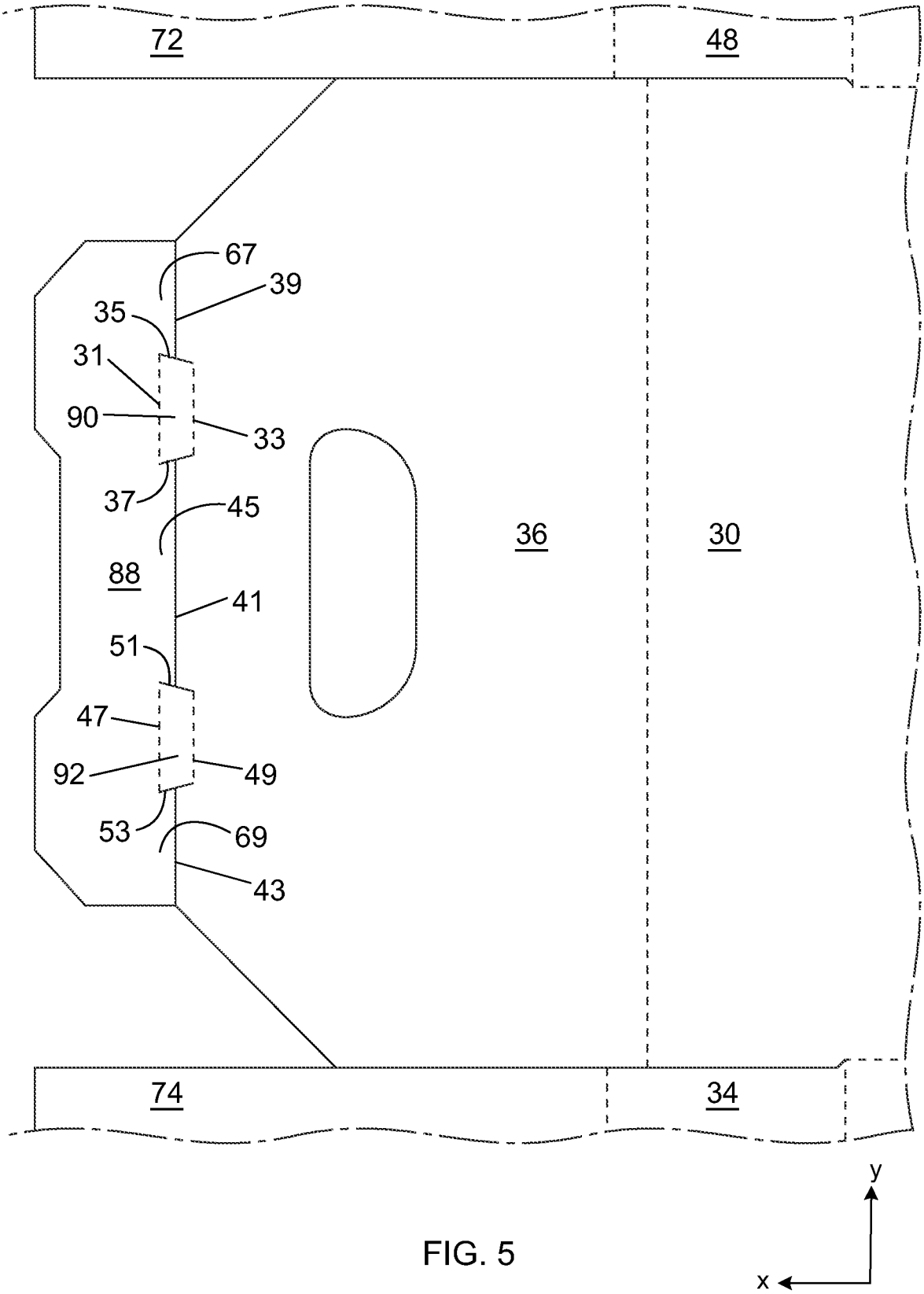
FIG. 5 is a magnified view of the first end wall panel of the blank of FIG. 2.

FIG. 5 illustrates the first end wall panel 36, the rollover flap 88, and the hinge portions 90 and 92 in greater detail. The hinge portions 90 and 92 can be trapezoidal. In certain examples, the hinge portions 90 and 92 can have a wedge shape. For example, the hinge portions 90 and 92 can be defined by parallel fold lines and non-parallel cuts. For example, the hinge portion 90 can comprise two fold lines 31 and 33 spaced apart from each other along the x-axis. The fold line 31 can be formed in the rollover flap 88 and the fold line 33 can be formed in the first end wall panel 36. The fold lines 31 and 33 can be parallel or substantially parallel to the y-axis and to each other. In the illustrated configuration the outer fold line 31 (the inner fold line in the erected container) is longer than the inner fold line 33 (the outer fold line in the erected container). In certain examples, the outer fold line 31 can be 5% to 50% longer than the inner fold line 33, such as 10% to 50%, 10% to 40%, 10% to 30%, etc. In the illustrated example the outer fold line 31 is 20% longer than the inner fold line 33.

A first cut 35 can extend between the fold lines 31 and 33 along a first edge (e.g., the upper edge in FIG. 5) of the hinge portion 90. A second cut 37 can extend between the fold lines 31 and 33 along a second edge (e.g., the lower edge in FIG. 5) of the hinge portion 90. One or both of the first and second cuts 35 and 37 can be angled relative to the x-axis. In the example illustrated in FIG. 5, the first and second cuts 35 and 37 are angled toward each other relative to the x-axis in a manner such that if the cuts were extended into the panel 36 they would eventually intersect. In certain examples, the first cut 35 and/or the second cut 37 can form an angle of 10° to 45° with the x-axis, such as 10° to 30° or 20°. In some examples, the angle of the first cut 35 can be different from the angle of the second cut 37.

The hinge portion 92 can be defined by two fold lines 47 and 49 and two angled cuts 51 and 53 extending between the fold lines 47 and 49 similar to the hinge portion 90.

Still referring to FIG. 5, a cut 39 (also referred to as a slit) can extend from a first side edge (e.g., the upper edge in FIG. 5) of the rollover flap 88 to the first hinge portion 90 (and/or to the cut 35). A cut 41 can extend between the hinge portions 90 and 92, and a cut 43 can extend from the lower edge of the hinge portion 92 to a second edge (e.g., the lower edge in FIG. 5) of the rollover flap 88. Thus, the rollover flap 88 is attached to the first end wall panel 36 only by the hinge portions 90 and 92, and is articulable relative to the first end wall panel 36 about the hinge portions 90 and 92. The cuts 37, 41, and 51 can create a tab portion 45 on the inward aspect of the rollover flap 88. Stated differently, the innermost cut 37 of the hinge portion 90 and the innermost cut 51 of the hinge portion 92 can at least partially define the tab 45, in combination with the cut 41. A tab 67 is also formed on the other side of the hinge portion 90 from the tab 45, and a tab 69 is formed on the other side of the hinge portion 92 from the tab 45. When the container 10 is assembled and the rollover flap 88 is folded over the end flap panels 72 and 74, the tabs 45, 67, and 69 can extend upwardly as shown in FIG. 6 and as discussed in more detail below.

The rollover flap 87 can be coupled to the second end wall panel 38 by two hinge portions 55 and 57 (FIG. 2), which can be shaped and sized similarly to the hinge portions 90 and 92.

To erect the container 10 from the blank 100, the side wall flaps 32 and 34 can be rotated upwardly about the respective fold lines 40 and 42. The end wall panels 36 and 38 can be folded upwardly. The end flap panels on each side can then be folded inwardly behind the respective end wall panels 36 and 38. For example, the end flap panels 72 and 74 can be folded or tucked inwardly of the first end wall panel 36. In the illustrated example, the end flap panel 72 can be positioned inwardly of the end flap panel 74 such that the end flap panel 74 is sandwiched between the first end wall panel 36 on the outside of the container and the end flap panel 72 on the inside of the container. The rollover flap 88 can then be folded over the end flap panels 72 and 74 such that the rollover flap 88 is on the inside of the container and pointed generally downward in the direction of the bottom panel 30. The hinge portion 90 can be received in the notch 82B of the end flap panel 72 and in the notch 84A of the end flap panel 74. The hinge portion 92 can be received in the notch 82A of the end flap panel 72 and in the notch 84B of the end flap panel 74. After assembly, the rollover flap 88 can engage the end flap panels 72 and 74 such that the end wall panel 36, the end flap panel 74, and the end flap panel 72 form the first end wall 18.

Figure 6:
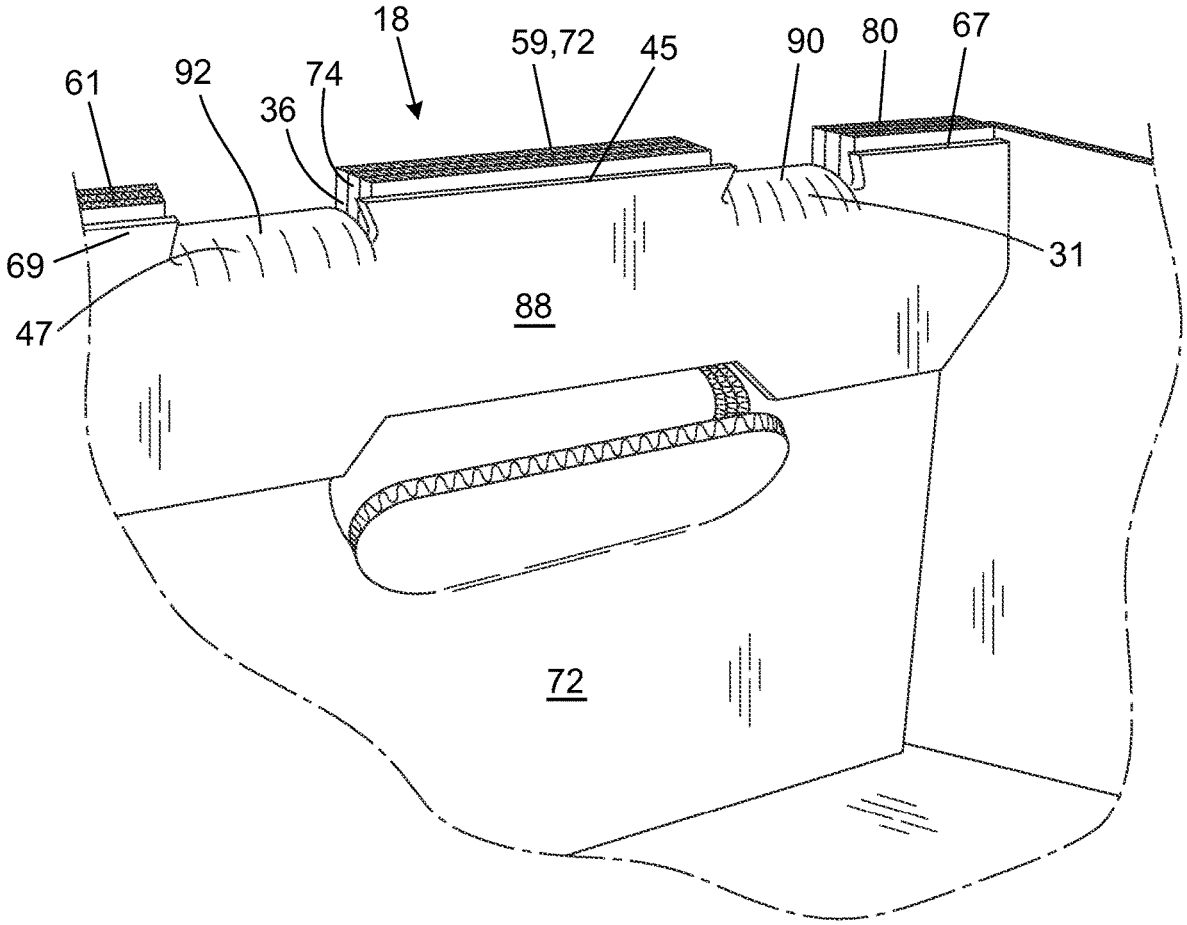
FIG. 6 is a perspective view from the interior of the container of FIGS. 1A-1B showing a part of the first end wall of the container.

FIG. 6 illustrates the first end wall 18 in the assembled state. It can be seen that the longer fold lines 31 and 47 of the hinge portions 90 and 92, respectively, are positioned on the inside of the container. This has the effect of wedging the hinge portions in the notches, and reduces the likelihood that the hinge portions will inadvertently disengage from the notches. Additionally, as noted above the tab 45 between the two hinge portions 90 and 92 of the rollover flap 88 can extend upwardly. Because the depth $D_1$ of the notches 82A and 82B of the first end flap panel 72 is greater than the depth $D_2$ of the notches 84A and 84B of the second end flap panel 74, the rollover flap 88 can extend deeper into the container on the inside of the first end wall 18 than if all four notches had the same depth. In certain examples, the hinge portions (or at least inward portions of the hinge portions) can be angled downwardly in the notches (e.g., at the locations where the hinge portions pass through the notches of the first end flap panel 72). As a result, the tab 59 of the first end flap panel 72 extends upwardly beyond the upper edge of the tab 45 of the rollover flap 88. The tab 61 of the first end flap panel 72 also extends upwardly beyond the tab 69 of the rollover flap 88. The portion of the first end flap panel 72 to the right of the hinge portion 90 also extends upwardly beyond the tab 67. Stated differently, the outer edge 80 (e.g., the upper edge in the erected configuration) of the first end flap panel 72 extends upwardly beyond the outer edge (e.g., the upper edge in the erected configuration) of the rollover flap 88 collectively defined by the tabs 45, 67, and 69. This can advantageously lock the rollover flap 88 in place and prevent inadvertent disassembly of the first end wall 18. The second end wall 20 can be formed by arranging, from inside to outside, the end flap panel 76, the end flap panel 78, and the second end wall panel 38, and folding the rollover flap 87 over so that the hinge portions 55 and 57 are received in the respective notches of the end flap panels 76 and 78.

In other examples, the notches 84 on the end flap panels 74 and 78 can be the deeper notches, and the end flap panels 74 and 78 can be disposed on the inside of the end walls in the erected container.

Figure 7:
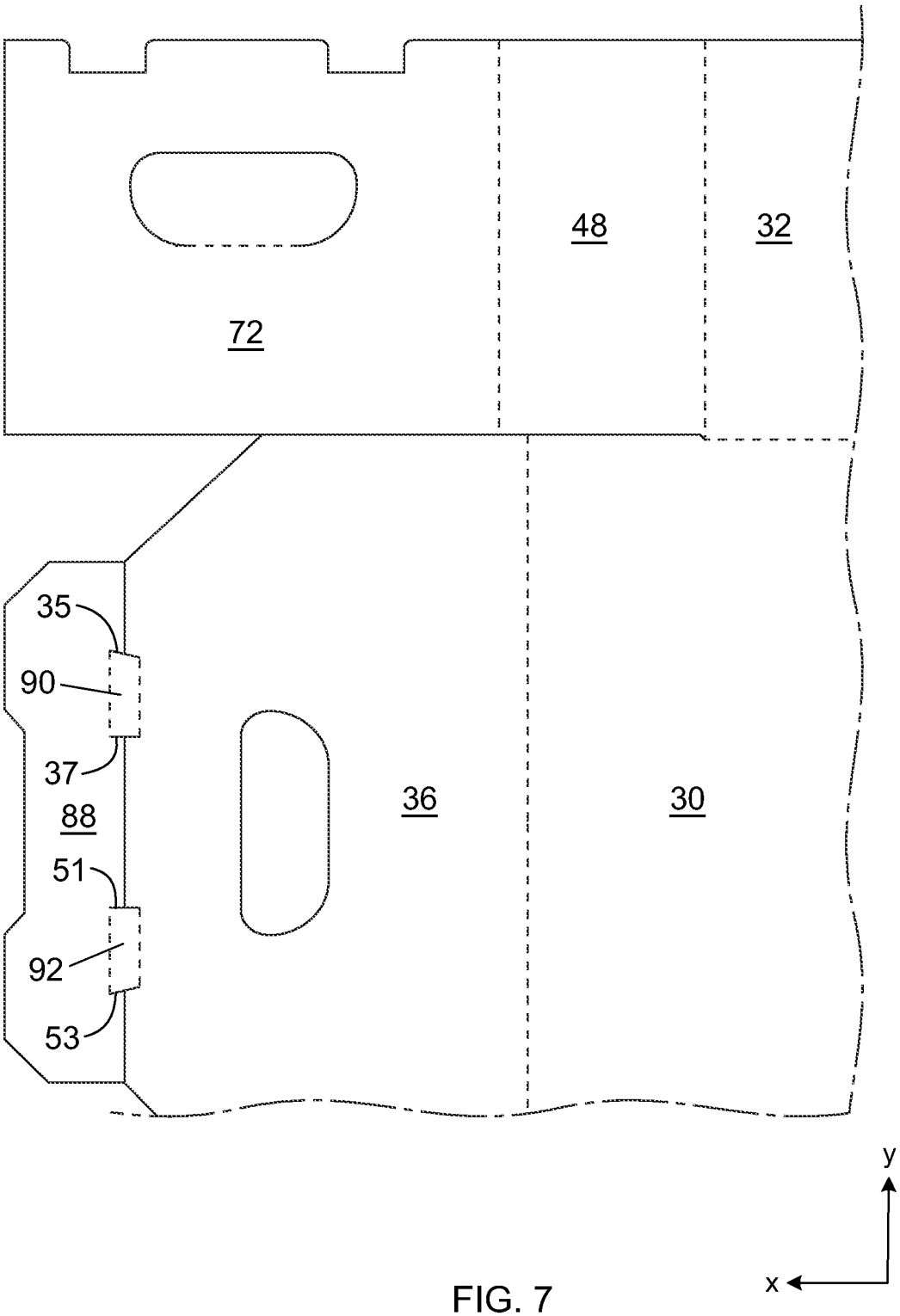
FIG. 7 illustrates a portion of the first end wall panel and the first end flap panel of the container of FIGS. 1A-1B including another example of hinge portions.
Figure 8:
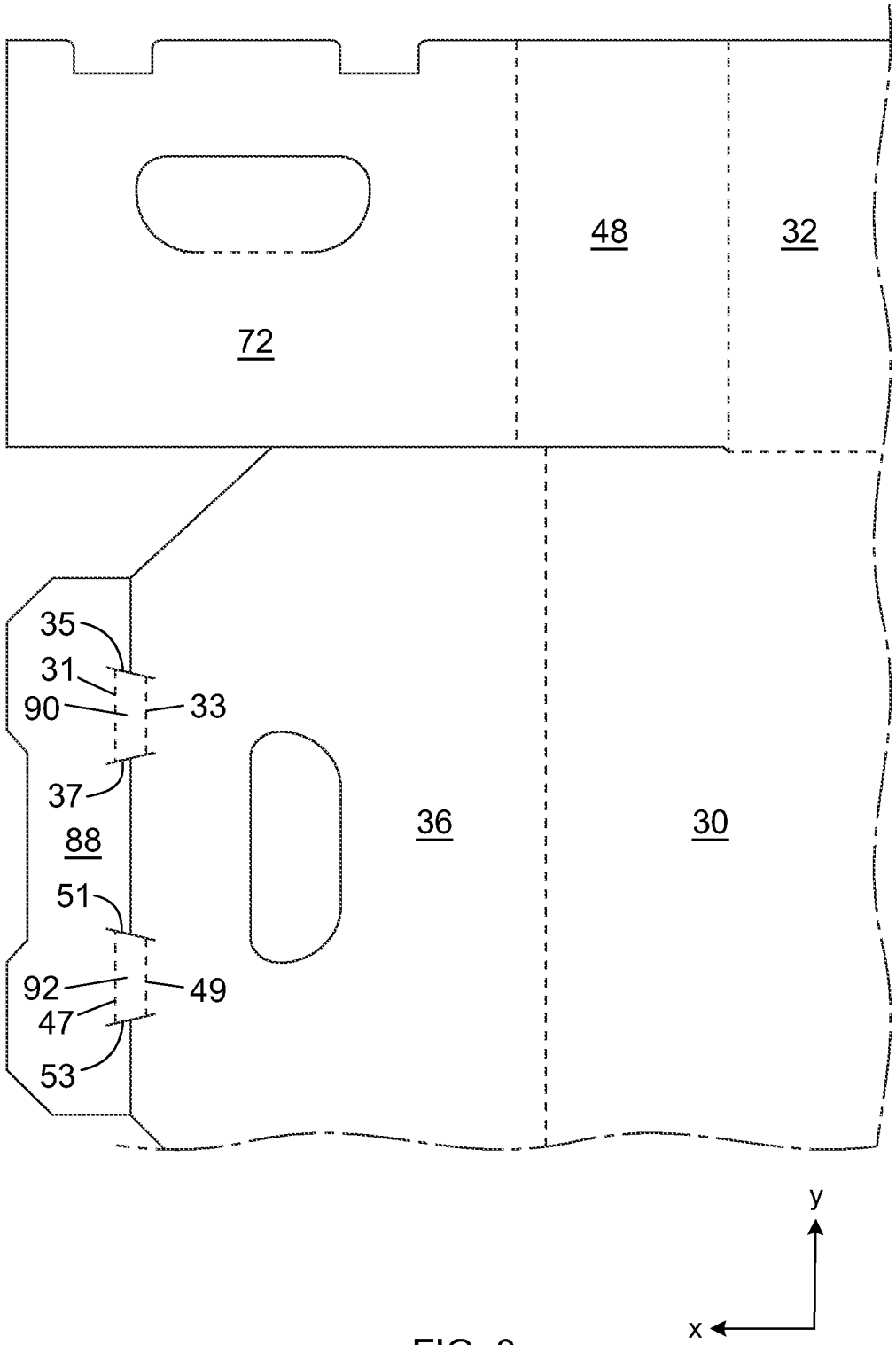
FIG. 8 illustrates a portion of the first end wall panel and the first end flap panel of the container of FIGS. 1A-1B with yet another example of hinge portions.

As noted above, the hinge portions of the rollover flaps can be shaped differently depending on the particular characteristics sought. For example, FIG. 7 illustrates an example in which the outward cuts 35 and 53 of the hinge portions 90 and 92 are angled relative to the x-axis while the inward cuts 37 and 51 are parallel or substantially parallel to the x-axis. The reverse configuration can also be implemented in which the cuts 37 and 51 are angled and the cuts 35 and 53 are parallel or substantially parallel to the x-axis. The cuts of the hinge portions can also extend beyond the fold lines on one or both ends of the hinge portions. For example, FIG. 8 illustrates an example in which the cuts 35 and 37 of the hinge portion 90 extend beyond the fold line 31 into the rollover flap 88, and beyond the fold line 33 into the first end wall panel 36. The cuts 51 and 53 of the hinge portion 92 also extend beyond the fold line 47 into the rollover flap 88 and beyond the fold line 49 into the first end wall panel 36. Hinge portions shaped and sized as shown in FIGS. 7 and 8 can be more resistant to inadvertent disassembly than hinge portions in which all of the cuts 35, 37, 51, and 53 are parallel and form a right angle with the fold lines. They can also be easier to disassemble than configurations in which both cuts of a hinge portion are angled, and thus suited for use in circumstances where it may be desirable to disassemble the container.

Example 2: Container Covers with Locking Rollover Flaps

Figure 9:
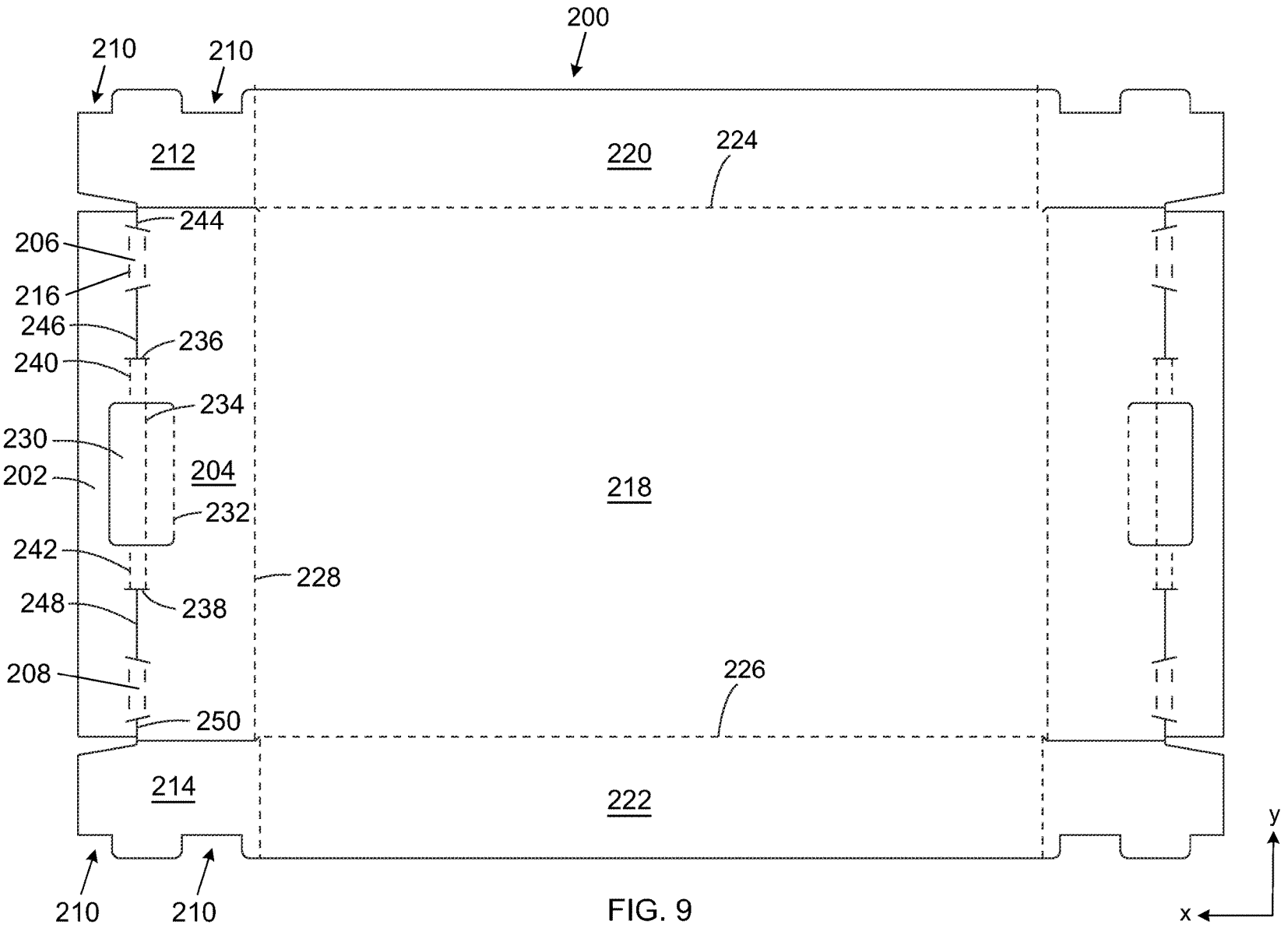
FIG. 9 illustrates a blank for a container cover with locking rollover flaps.

Any of the trapezoidal and/or wedge-shaped hinge portions described herein can also be implemented on covers for containers where the covers include rollover flaps and overlapping end flap panels similar to those described above. Notches having different depths as described above can also be implemented on covers, with or without trapezoidal and/or wedge-shaped hinge portions. FIG. 9 illustrates a representative example of a blank 200 for a container cover including trapezoidal and/or wedge-shaped hinge portions interconnecting rollover flaps and end wall panels. For example, a rollover flap 202 is coupled to an end wall panel 204 by hinge portions 206 and 208. Notches 210 are formed in end flap panels 212 and 214. The notches in one end flap panel can be deeper than the notches in the other end flap panel as described above. In the illustrated example, the hinge portions 206 and 208 can include fold lines comprising perforations 216 instead of or in addition to creases extending in the direction of the y-axis. A cover formed from the blank 200 can be used in combination with any of the container examples described herein.

The cover blank 200 can further comprise a main top panel 218 and two side panels 220 and 222. The side panels 220 and 222 can be coupled to the main top panel 218 at respective fold lines 224 and 226. The end wall panel 204 can be coupled to the main top panel 218 along a fold line 228.

The cover blank 200 can also comprise a dart lock tab 230 that is located partially on the end wall panel 204 and partially on the rollover flap 202. The dart lock tab 230 can be foldably coupled to the end wall panel 204 by a fold line 232. A fold line 234 can extend across the dart lock tab 230 and onto the end wall panel 204 on both sides of the dart lock tab 230. The fold line 234 can be bounded on one side by a relatively short cut 236 parallel to the x-axis and by a relatively short cut 238 on the opposite side of the dart lock tab 230 that is also parallel to the x-axis. A fold line 240 can extend from the cut 236 to the dart lock tab 230 and a fold line 242 can extend from the cut 238 to the dart lock tab 230. The fold lines 240 and 242 can be offset from the fold line 234 along the positive x-axis toward the outer edge of the rollover flap 202. Cuts 244, 246, 248, and 250 can define the boundary between the end wall panel 204 and the rollover flap 202.

In certain examples any of the fold lines of the containers and covers described herein can include scores (e.g., cuts that extend through one liner layer of the corrugated board but not through the corrugated layer beneath it) and/or perforations instead of or in addition to creases.

In certain embodiments, the containers and/or covers described herein can comprise any of various coatings on the interior and/or exterior surfaces to impart particular properties. For example, the containers and/or covers can include anti-abrasive coatings (e.g., polytetrafluoroethylene (PTFE)), hydrophobic or water-repellant coatings, and/or antistatic coatings to reduce the buildup of electric charge. Any of the coatings described herein can be combined in various layers and/or mixtures according to the particular properties sought, or as specified for a particular application.

The hand erectable containers and covers described herein can provide a number of significant advantages over existing hand erectable containers. For example, by making the hinge portions of the rollover flaps trapezoidal and/or wedge shaped, when the hinge portions are inserted in the notches of the end flap panels with the wider ends of the hinge portions on the inside of the container the trapezoidal hinge portions can strongly engage with the notches and resist being pulled out. This can reduce the likelihood of the hinge portions inadvertently disengaging from the notches. The shape of the hinge portions can also facilitate positioning (or aligning) the notches of the overlapped end flap panels for engagement by centering the notches when the hinge portions are inserted, helping to reduce interference and the time required for assembly. Additionally, by making the notches in the inner end flap panel of an end wall deeper than the notches of the outer end flap panel, the upper edge of the inner end flap panel can extend upwardly beyond the upper edge of the rollover flap (or tabs thereof) when the rollover flap is folded into place. The innermost end flap panel can thus engage and brace the rollover flap and prevent the rollover flap from inadvertently unlocking. The hinge portions and/or notch configurations described herein can also provide similar advantages when implemented on other parts of a container such as the corners, and in the context of other packaging items such as edge protectors.

Figure 10:
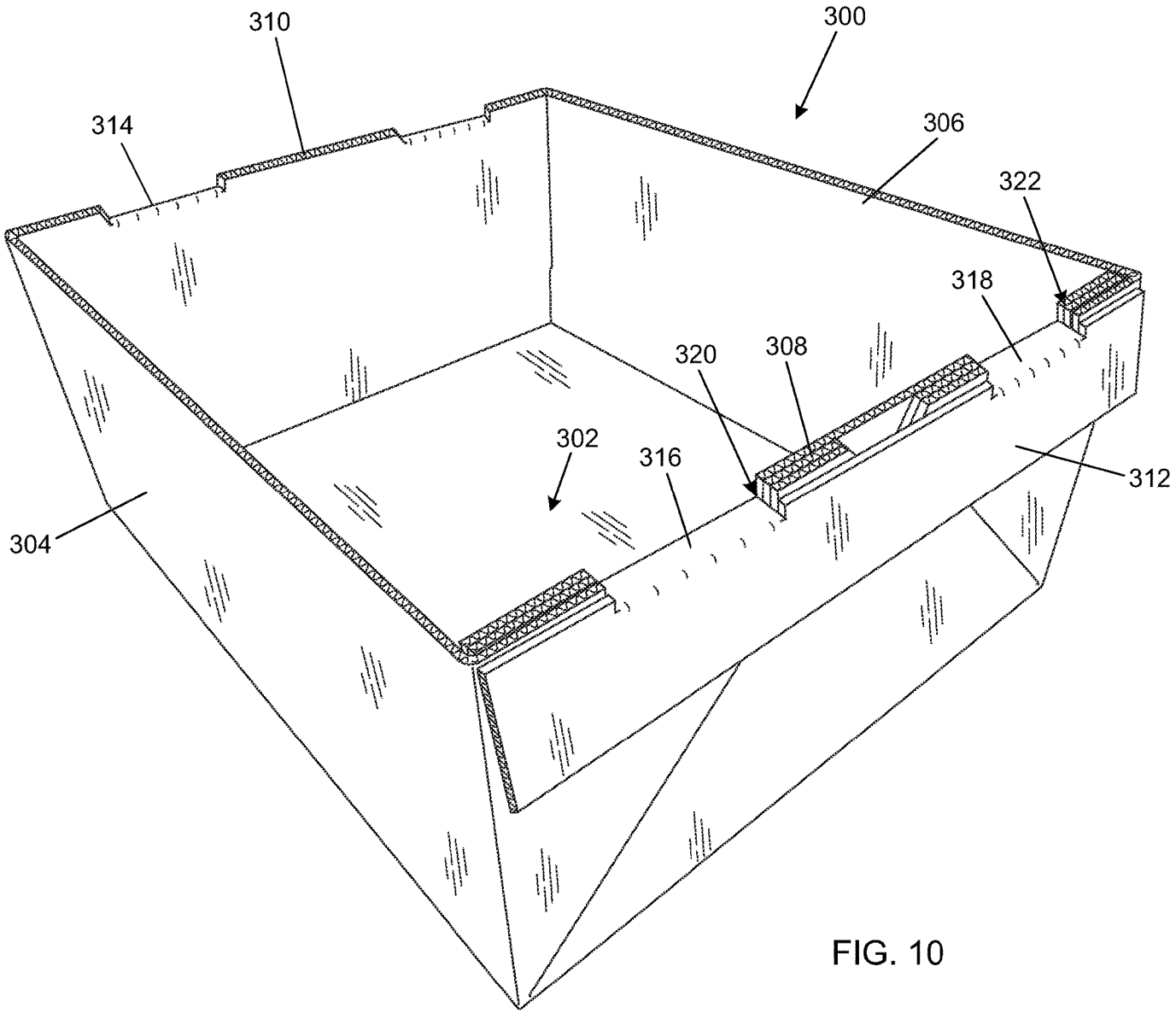
FIG. 10 illustrates another example of a container with locking rollover flaps that are folded from the inside of the container to the outside.

Example 3: Containers with Locking Rollover Flaps that Fold from the Inside to the Outside of the Container FIG. 10 illustrates another example of a container 300 including a bottom 302, a first side wall 304, a second side wall 306, a first end wall 308, and a second end wall 310, and in which the first end wall 308 includes a locking rollover flap 312 and the second end wall 310 comprises a locking rollover flap 314. The locking rollover flap 312 is coupled to the innermost panel of the first end wall 308 by hinge portions 316 and 318. The rollover flap 312 is folded over from the inside of the container to the outside of the container, and the hinge portions 316 and 318 are received in notches 320 and 322 formed in the first end wall 308. The hinge portions 316 and 318 can have a trapezoidal shape according to any of the examples described above, wherein the wider edges are disposed on the outside of the container when the rollover flap 312 is folded over. The depths of the recesses in the flaps that form the first end wall 308 can also be different, as described above. For example, the depth of the recesses in the outermost flap of the first end wall 308 can be greater such that the hinge portions 316 and 318 slope downwardly in a direction from the inside of the container toward the outside of the container when received in the notches. The rollover flap 314 and associated hinge portions and notches of the second end wall 310 can be configured similarly to those of the first end wall 308.

In view of the many possible embodiments to which the principles of the disclosed technology may be applied, it should be recognized that the illustrated embodiments are only preferred examples and should not be taken as limiting the scope of the disclosure. Rather, the scope of the disclosure is at least as broad as the following claims and equivalents of the recited features. We therefore claim all that comes within the scope and spirit of these claims.

The invention claimed is:

1. A container, comprising:

a bottom panel forming a container bottom;

a first side wall panel coupled to the bottom panel and forming a first side wall of the container;

a second side wall panel coupled to the bottom panel and forming a second side wall of the container;

a first end wall panel coupled to the bottom panel and forming a first end wall of the container;

a second end wall panel coupled to the bottom panel and forming a second end wall of the container;

a first end flap panel coupled to the first side wall panel, the first end flap panel comprising an upper edge defining a notch;

a second end flap panel coupled to the second side wall panel on the opposite side of the first end wall panel from the first end flap panel, the second end flap panel comprising an upper edge defining a notch;

a first rollover flap coupled to the first end wall panel by a trapezoidal hinge portion including two parallel fold lines and two non-parallel cuts;

wherein the first end flap panel and the second end flap panel are folded into an overlapping arrangement inward of the first end wall panel such that the notch of the first end flap panel is aligned and overlaps with the notch of the second end flap panel; and wherein the first rollover flap is folded over the first end flap panel and the second end flap panel and downwardly inside the container, and the trapezoidal hinge portion is received in the notch of the first end flap panel and the notch of the second end flap panel to form the first end wall.

2. The container of claim 1, wherein:

the notch of the first end flap panel has a first depth; and the notch of the second end flap panel has a second depth that is different from the first depth.

3. The container of claim 2, wherein the first depth is greater than the second depth.

4. The container of claim 3, wherein:

the first end flap panel is disposed inwardly of the second end flap panel;

the first rollover flap comprises an upwardly extending tab on the inside of the container; and the upper edge of the first end flap panel extends upwardly beyond an upper edge of the tab of the first rollover flap.

5. The container of claim 4, wherein at least an inward portion of the hinge portion is angled downwardly as it extends through the notch of the first end flap panel.

6. The container of claim 4, wherein the tab of the first rollover flap is at least partially defined by an innermost cut of the two non-parallel cuts of the hinge portion.

7. The container of claim 1, wherein the two non-parallel cuts of the hinge portion are angled toward each other such that the hinge portion has a wedge shape.

8. The container of claim 1, wherein one of the two non-parallel cuts of the hinge portion is perpendicular to the two parallel fold lines of the hinge portion.

9. The container of claim 1, wherein the two non-parallel cuts extend beyond a first of the two parallel fold lines into the first rollover flap and beyond a second of the two parallel fold lines into the first end wall panel.

10. The container of claim 1, wherein the first rollover flap comprises a plurality of tabs, the tabs comprising upper edges that are below the upper edge of the first end flap panel.

11. The container of claim 1, further comprising a second rollover flap coupled to the second end wall panel by a trapezoidal hinge portion including two parallel fold lines and two non-parallel cuts.

12. The container of claim 1, further comprising a cover including a main top panel, first and second side wall panels coupled to the main top panel, first and second end wall panels coupled to the main top panel, a first end flap panel coupled to the first side wall panel, the first end flap panel comprising an outer edge defining a notch, a second end flap panel coupled to the second side wall panel on the opposite side of the first end wall panel from the first end flap panel, the second end flap panel comprising an outer edge defining a notch, a first rollover flap coupled to the first end wall panel by a trapezoidal hinge portion including two parallel fold lines and two non-parallel cuts, and a second rollover flap coupled to the second end wall panel by a trapezoidal hinge portion including two parallel fold lines and two non-parallel cuts.

13. The container of claim 1, wherein an outermost layer of the first end wall is the same height as an intermediate layer of the first end wall.

14. A container, comprising:

a bottom panel forming a container bottom;

a first side wall panel coupled to the bottom panel and forming a first side wall of the container;

a second side wall panel coupled to the bottom panel and forming a second side wall of the container;

a first end wall panel coupled to the bottom panel and forming a first end wall of the container;

a second end wall panel coupled to the bottom panel and forming a second end wall of the container;

a first end flap panel coupled to the first side wall panel, the first end flap panel comprising an upper edge defining a notch having a first notch depth;

a second end flap panel coupled to the second side wall panel on the opposite side of the first end wall panel from the first end flap panel, the second end flap panel comprising an upper edge defining a notch having a second notch depth;

a first rollover flap coupled to the first end wall panel by a hinge portion;

wherein the first end flap panel and the second end flap panel are folded into an overlapping arrangement inward of the first end wall panel with the first end flap panel disposed inwardly of the second end flap panel and such that the notch of the first end flap panel is aligned with the notch of the second end flap panel;

wherein the first rollover flap is folded over the first end flap panel and the second end flap panel and downwardly inside the container, and the hinge portion is received in the notch of the first end flap panel and the notch of the second end flap panel to form the first end wall;

wherein the first rollover flap comprises an upwardly extending tab on the inside of the container, and an upper edge of the first end flap panel extends upwardly beyond an upper edge of the tab of the first rollover flap; and wherein the hinge portion is a trapezoidal hinge portion including two parallel fold lines and two non-parallel cuts.

15. The container of claim 14, wherein the first notch depth is greater than the second notch depth.

16. The container of claim 14, wherein the tab of the first rollover flap is one of a plurality of tabs of the first rollover flap, and each tab of the plurality of tabs comprises an upper edge that is below the upper edge of the first end flap panel.

17. A container blank, comprising:

a bottom panel;

first and second side wall panels coupled to the bottom panel;

first and second end wall panels coupled to the bottom panel;

a first end flap panel coupled to the first side wall panel, the first end flap panel comprising an outer edge, the outer edge defining a notch having a first notch depth;

a second end flap panel coupled to the second side wall panel on the opposite side of the first end wall panel from the first end flap panel, the second end flap panel comprising an outer edge, the outer edge of the second end flap panel defining a notch having a second notch depth that is less than the first notch depth;

a first rollover flap coupled to the first end wall panel by a hinge portion; and a second rollover flap coupled to the second end wall panel by a hinge portion.

18. The container blank of claim 17, wherein the hinge portion coupling the first rollover flap to the first end wall panel is a trapezoidal hinge portion including two parallel fold lines and two non-parallel cuts.

19. The container blank of claim 18, wherein the first rollover flap comprises a tab, and the tab is at least partially defined by an innermost cut of the two non-parallel cuts of the hinge portion.

20. The container blank of claim 18, wherein the two non-parallel cuts of the hinge portion are angled toward each other such that the hinge portion has a wedge shape.

21. A container blank, comprising:

a bottom panel;

first and second side wall panels coupled to the bottom panel;

first and second end wall panels coupled to the bottom panel;

a first end flap panel coupled to the first side wall panel, the first end flap panel comprising an outer edge defining a notch;

a second end flap panel coupled to the second side wall panel on the opposite side of the first end wall panel from the first end flap panel, the second end flap panel comprising an outer edge defining a notch;

a first rollover flap coupled to the first end wall panel by a trapezoidal hinge portion including two parallel fold lines and two non-parallel cuts; and a second rollover flap coupled to the second end wall panel by a trapezoidal hinge portion including two parallel fold lines and two non-parallel cuts;

wherein the first end flap panel and the second end flap panel are configured to be folded into an overlapping arrangement in which the notch of the first end flap panel overlaps the notch of the second end flap panel to receive the trapezoidal hinge portion when the container blank is erected.

* * * * *